US008590438B2

(12) United States Patent
Simovich

(10) Patent No.: US 8,590,438 B2
(45) Date of Patent: Nov. 26, 2013

(54) METHOD AND A DEVICE FOR PRE-STRESSED ARMOR

(76) Inventor: Gigi Simovich, Savion (IL)

( * ) Notice: Subject to any disclaimer, the term of this patent is extended or adjusted under 35 U.S.C. 154(b) by 0 days.

(21) Appl. No.: 13/127,090

(22) PCT Filed: Oct. 20, 2009

(86) PCT No.: PCT/IL2009/000987

§ 371 (c)(1),
(2), (4) Date: May 2, 2011

(87) PCT Pub. No.: WO2010/052700

PCT Pub. Date: May 14, 2010

(65) Prior Publication Data

US 2011/0214561 A1 Sep. 8, 2011

(30) Foreign Application Priority Data

Nov. 4, 2008 (IL) ..... 195090

(51) Int. Cl.
*F41H 5/02* (2006.01)

(52) U.S. Cl.
USPC ..... 89/36.02; 89/908

(58) Field of Classification Search
USPC ..... 89/36.01–36.05, 36.07, 903, 906–909; 109/49.5; 2/2.5
See application file for complete search history.

(56) References Cited

U.S. PATENT DOCUMENTS 3,616,115 A * 10/1971 Klimmek ..... 109/84
4,665,794 A * 5/1987 Gerber et al. ..... 89/36.02
4,760,611 A 8/1988 Huet et al.
5,361,678 A 11/1994 Roopchand
H1434 H 5/1995 Cytron
5,686,689 A * 11/1997 Snedeker et al. ..... 89/36.02
5,972,819 A 10/1999 Cohen
6,332,390 B1 12/2001 Lyons
6,532,857 B1 3/2003 Shih
6,826,996 B2 * 12/2004 Strait ..... 89/36.02
6,860,186 B2 3/2005 Cohen
6,892,623 B2 5/2005 Benyami et al.
7,117,780 B2 10/2006 Cohen
7,874,239 B2 1/2011 Howland
2004/0020353 A1 2/2004 Ravid et al.
2007/0034074 A1 2/2007 Ravid et al.
2009/0241764 A1 10/2009 Cohen
2010/0043630 A1 2/2010 Sayre et al.

FOREIGN PATENT DOCUMENTS

EP 1363101 11/2003
FR 2526535 11/1983
WO WO2007048370 5/2007

OTHER PUBLICATIONS

Holmquist and Johnson (EDP Sciences 2003).
Yiwang Bao et al (material letters Dec. 2002).

* cited by examiner

*Primary Examiner* — Michael Carone
*Assistant Examiner* — Reginald Tillman, Jr.
(74) *Attorney, Agent, or Firm* — Robert G. Lev

(57) ABSTRACT

Composite materials in various shapes and sizes and in various configurations for use in ballistic armor confined in cylindrical and dome shaped enclosures; held under pressure to increase the impact absorption factor. An armor comprising an auxiliary layer disposed in front thereof at a determined distance wherein said layer comprises pre-stressed members arranged in a spacious pattern. A method is proposed for manufacturing of pre-stressed structure and armor by expanding the cavity into which ceramic materials are inserted so that pressure is applied to the ceramic materials.

5 Claims, 5 Drawing Sheets

METHOD AND A DEVICE FOR PRE-STRESSED ARMOR

FIELD OF THE INVENTION

This invention is in the field of ballistic armor and in the field of reinforced masonry structures.

BACKGROUND OF THE INVENTION

Ballistic armor is well known in the art as is herein detailed and described together with explanation why the prior art could be improved or in some essential features is different from the present invention.

U.S. Pat. No. 5,972,819 issued to Cohen reveals ceramic bodies in composite armor where the ceramic bodies end-face curvature is in a specific range of sizes relative to the diameter of the ceramic body.

U.S. Pat. No. 7,117,780 issued to Cohen reveals composite armor plate using a layer of pellets held by elastic material.

U.S. Pat. No. 6,860,186 issued to Cohen reveals a ceramic body in ballistic armor where the ceramic body is peg shaped with a head and a stem.

French patent No. 2526535 issued to Pequignot reveals ceramic elements embedded into a metallic plate and thermally stressed.

The Pequignot arrangement can not exploit the full potential of the metal to stress the ceramic elements since a major part of the embedding metal does not contribute to efficient confinement and stressing.

In European patent application No. 13631001 by Ravid et al, an arrangement of pellets is proposed wherein a belt member is adapted to provide inward radial compression to said pellets.

U.S. Pat. No. 6,826,996 issued to Strait reveals composite armor in a honeycomb structure with polygon openings and inserts in the openings. A method of manufacturing is revealed for filling the polygon openings with resin.

U.S. Pat. No. 5,361,678 issued to Roopchand reveals coated ceramic bodies in composite armor where the ceramic bodies are embedded in a metal matrix. In the international application No 2007048370 by Weber et al proposes a composite armor which comprises elongated rods arranged in parallel with each other.

U.S. Pat. No. 5,686,689 issued to Snedeker reveals lightweight composite armor in a matrix block with a planar back, intersecting ridges and fillets. In each cell there is an energy absorbing ceramic material.

U.S. Pat. No. 6,532,857 issued to Shih reveals a ceramic array armor confined with shock isolated ceramic tiles with rubber between the tiles and over the top of them. Polysulfide is used as an encapsulation component.

U.S. Pat. No. 6,332,390 issued to Lyons reveals ceramic tile armor with enhanced joint and edge protection using ceramic strips with adhesive.

The experimental results by Holmquist and Johnson (EDP Sciences 2003) show that pre-stressed ceramics does improve performance.

Yiwang Bao etal (materials letters December 2002) reported substantial enhancement in projectile penetration resistance in confined pre-stressed tiles. They also reported a 15 times enhancement of the impact resistance of a three dimensional pressed Alumina bar.

The writers further conclude that a three dimensional stressing of ceramic provides a higher enhancement in the impact resistance then a two dimensional stressing.

US statutory invention number H1434 reveals a method for assembling pressed ceramic tiles is suggested by compressing thermoplastic material into a cavity. The above prior art uses different methods to increase the impact absorption factor of armor by subjecting ceramic elements to pre-stress.

The methods that were known for achieving pre-stress in armor prior to the present invention were by compressing thermoplastic material into a cavity, a method which involves a weight penalty due to low ballistic efficiency of the thermoplastic material and thermal shrink fitting, a method which is limited by the adverse influence of high temperatures on the enclosure properties.

The present invention reveals an armor comprising confined and pre-stressed ceramic elements of novel kinds, formations and combinations, and a novel method of achieving lightweight and highly stressed ceramic armor and thus increases the impact absorption factor.

The present invention is characterized by the provision of one or more of the following; efficient arrangements of confined and pressed ceramic elements wherein the elements are pressed in three dimensions, efficient arrangements of pressed ceramic elements wherein pressure is applied to the strike face of the ceramic elements, confined and stressed ceramic elements by enclosures that are shaped like pressure vessels comprising cylindrical and dome shaped surfaces, the use of light weight efficient cylindrical and dome shaped pressurized enclosure segments enables to achieve a uniform high stress in the enclosure, The present invention also provides an armor comprising an auxiliary layer disposed in front thereof at a determined distance wherein said layer comprises a confined and pre-stressed members arranged in a spacious pattern.

It is also the scope of the present invention to provide a steel and concrete pre-stressed member used for civil engineering structures as well as in armor and fortified structures that is light weight, blast and impact resistant and can better withstand earthquakes.

SUMMARY OF THE INVENTION

It is to be understood that both the foregoing general description and the following detailed description present embodiments of the invention and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention but not to limit the invention to these descriptions only.

Definitions

Prism like shape:

Prisms are solid figures whose bases or ends are polygons that have the same size and shape and are parallel to one another, and each of those sides is a parallelogram.

Prism-like shape in this description will refer to a solid figure whose bases or end surface projection is a polygon or shapes with optionally curved segments. This shape is of uniform parallel cross section, its lateral surfaces are flat or single curved, the locus of the center of gravity of each parallel cross section is on a straight line, parallel to the lateral surfaces, which will be referred to as the shape axis.

Low shear strength material: low shear strength material will hereinafter refer to a material that can withstand high pressure stress but will not hold its shape under high shear stress.

For example: fluids, sand, rubber, cement, tar, organic polymers and powders.

Longitudinal direction in this description will refer to the direction that is perpendicular to the local armor surface.

Radial direction in this description will refer to a direction perpendicular to the longitudinal direction.

Parallel overlapping layers—in this description will refer to a set of parallel layers when a plane, parallel to the layers, exists that intersects the elements of both layers.

Honeycomb-like arrangement in this description will refer to an arrangement of uniform closely packed shapes in a layer wherein the shapes are cylindrical, hexagonal prisms or hexagonal prism-like shapes with recessed corners.

The shapes may comprise of various end surfaces.

The axis of each shape is perpendicular to the layer.

The shapes are arranged in parallel rows wherein each non peripheral shape is in contact or attached to two other consecutive shapes in each of the two adjacent rows and two other adjacent shapes from its own row.

Ceramic pellet: A ceramic pellet in this description will refer to a ceramic element shape which is predominantly cylindrical, hexagonal prism or hexagonal prism-like shape with recessed corners. The pellet may comprise of various end surfaces.

The present invention relates to a composite armor comprising multiple pre-stressed member assemblies.

In one embodiment of the present invention the assemblies comprise of elongated enclosures made of high tensile strength material having low creep, like Carbon fiber, Boron fiber, ceramic fiber, steel, Titanium alloy and aluminum alloy.

In that embodiment, prism-like shaped ceramic elements are disposed in a plurality of elongated enclosures cavities, wherein the enclosure exert pressure to the elements, whereby obtaining elongated pre-stressed members. The members are arranged in parallel, in one layer or in two overlapping layers wherein each member, except peripheral members, is attached to two other members.

The elongated enclosure is essentially of a uniform wall thickness in order to maximize the reinforcement effect by maintaining almost all the enclosure under high tension, keeping the ceramic elements in their place, and also providing low cost and low weight for the structure.

The form of the enclosure is a prism-like shape, preferably comprising flat surfaces where in contact with the adjacent enclosures and cylindrical surfaces towards the strike face and backing.

This shape ensures a minimum gap between ceramic elements and a maximum exploitation of the heavy or expensive enclosure material. An optionally hollow ceramic element could reduce weight. A circular cavity in the ceramic element concentrates the compressive stresses in the ceramic and also can act as a crack stopper.

In another preferred embodiment of the present invention the composite armor comprises high tensile strength board member wherein multiple parallel cavities of uniform cross section are provided in a single layer parallel to the board surface. The parallel cavities have flat surfaces between one another since adjacent cavities are of equal pressure; and cylindrical surfaces towards the strike face and rear side of the board to effectively hold the internal pressure.

The thickness of an internal inter-cavity flat surface is preferably thicker then the external surfaces. The above cavity form is better suited to hold pressure. Elongated or multiple segmented prism-like shaped ceramic elements are tightly disposed within each cavity and held under pressure. The use of a multi cavity board enclosure provides enhanced ballistic efficiency armor as well as an armor that is self supporting and structurally strong.

In another preferred embodiment of the present invention a composite armor comprising pellets having a circular cross-section, hexagonal or hexagonal with recessed corners cross-section, are each disposed in an enclosure which is essentially subjected to tension and wherein the pellets are subjected to pressure by the enclosure. Pressure can be applied to the whole surface of the pellet or to a part of it.

The enclosed or encapsulated pellets are arranged in a honeycomb-like arrangement with one end face surface facing the exterior strike face and the other facing the interior backing layer.

The pellet surface facing the exterior and interior can be concave, convex or flat.

In a preferred variation of the present invention; thin walled cylindrically shaped enclosures with a convex exterior dome shaped end faces are used to confine and pressurize the ceramic pellets. This form is most effective for providing a three dimensional pressurization of the ceramic pellets with minimum weight penalty. The dome shaped end face effectively exerts pressure onto the ceramic dome shaped strike face.

When using cylindrical pellets in a honeycomb-like arrangement, gaps exist at the center of gravity points of each adjacent triangle of three pellets. As the thickness of the enclosure is increased the gap widens and this point becomes more vulnerable.

This problem limits the thickness of the enclosures and thus the degree of pressurization. This problem is less severe when pellets are hexagonal or for the embodiment that comprises elongated parallel members.

An optional use of an intermediate layer of rubber between ceramic elements and the enclosures can assure a better distribution of pressure at the ceramic surface and can simplify the production methods, despite some weight penalty. Materials used for hard elements inside the individual members include brittle hardened steel, ceramics, like: Aluminum oxide, Titanium boride, Silicon Nitride, Silicon Carbide, Boron Carbide, glass and concrete.

Ductile material or high tenacity fiber layers are added to a backing layer opposite the above mentioned more brittle materials layer to aid impact adsorption.

The present invention also effectively provides an armor wherein pressure is applied to the strike surface of the ceramic elements, this delays the disintegration of the ceramic in a ballistic event.

A concave or dimpled ceramic strike surface creates a beneficial concentration of reinforcing stress at the surface due to radial pressure from lateral surfaces as opposed to the case of pre-stressed ceramic with convex strike face and lateral radial pressure where the induced stress at the strike face is dissipated and reduced.

A concave surface also provides more thickness at the periphery of the ceramic element and provides reinforcement at the more vulnerable periphery while maintaining the benefit of inclined surface at the strike face.

The preferred relationship of the depth of the ceramic body or pellet to the diameter or lateral dimension of the pellet is in the range of 0.3-2.

It is also in the scope of the present invention to provide an armor comprising an auxiliary layer disposed in front thereof at a determined distance wherein said layer comprises tensioned pre-stressed enclosure members made of Titanium, carbon fibers or steel, and arranged preferably in a spacious pattern. The auxiliary layer reduces the impacting energy of an incoming bullet and more important, it has a penetration resistance lateral gradient that statistically turns the axis of an incoming armor piercing projectile at an angular velocity away from its velocity vector. This causes the projectile to hit the main armor layer at reduced speed and an unfavorable angle of attack for penetration. In this case, gaps between adjacent ceramic elements, gaps between adjacent enclosures and enclosure thickness could be substantially bigger.

Therefore higher degree of stress and reinforcement could be obtained. Both tensioned metal and pressed ceramic have improved ballistic properties than their unstressed counterparts.

This may suggest that although a highly synergistic effect could be obtained by pressurizing ceramic with tensioned metallic enclosure.

Multiple ceramic elements are disposed within the hollow rods at determined gaps separated by light weight spacers, the elements are subjected to pressure by the rods.

This arrangement provides ballistic resistance gradient in all lateral directions thus it provides high probability for projectile deflection.

The present invention reveals a method of producing pre-stressed members of armor.

In a preferred method for producing the pre-stressed members, an elongated enclosure is inserted into a jig assembly tube cavity that has a similar but enlarged cross-sectional shape.

The jig can be a massive steel tube with a shaped cavity. The elongated enclosure is pressurized by applying a hydraulic or pneumatic pressure to its cavity, the enclosure walls inflate to take the form of the jig cavity.

Ceramic elements with similar cross-section but bigger than the unstressed cavity are inserted to fill the space of the enlarged inflated cavity.

The size of elements is chosen so they can fit into the enlarged cavity while inflated.

The pressure is reduced, the pressurizing fluid is removed and the enclosure walls deflate to the degree that the inserted elements allow. Since the cavity of the enclosure is smaller when unstressed than the space occupied by ceramic elements, the enclosure walls remain stressed and the ceramic elements are under pressure.

When depressurized the enclosure also contracts along its length, a fact that can enable to pressurize the elements in three dimensions wherein elements exert pressure on to its neighbor within the enclosure.

This method can provide highly stressed members without the weight and space penalty of the removed pressurizing fluid.

In another method of producing a pre-stressed member of the ceramic armor, the ceramic elements are placed in an enclosure that preferably comprises single curvature surfaces, cylindrical surfaces or spherical surfaces. Substances like rubber, cement or unset epoxy resin are inserted into the enclosure under pressure and allowed to harden. When hardened, pressure remains around the ceramic elements.

In similar way, when pressurizing and setting cement in a steel enclosure that comprises cylindrical surfaces a pre-stressed member is provided that can be used for civil engineering structures as well as in armor and fortified structures. Such structure is low cost, light weight, blast and impact resistant and can better withstand earthquakes.

This technique can in some instances be used for the reinforcement of old existing structures like pillars and beams; a cylindrical steel enclosure is built around a pillar or beam, the enclosure is sealed, the gap between the enclosure and pillar or beam is filled with wet cement and the enclosure is pressurized. The cement is set while under pressure and thus a laterally pre-stressed reinforced structure is obtained.

In another method of producing a pre-stressed member of the ceramic armor, metal deep drawing is used. A ceramic pellet optionally surrounded with a thin layer of rubber is placed on a metal lubricated tray or pre-drawn shape and, is drawn under pressure to produce a cup-shaped enclosure around the ceramic pellet. The cup shaped base opening is closed around the pellet by means of cold spinning or bending the edge of the enclosure. High residual stresses remain after this forming technique hence the pressurizing and stress.

BRIEF DESCRIPTION OF THE DRAWINGS

The accompanying drawings, which are incorporated in and form a part of this specification, illustrate embodiments of the invention and together with the description, serve to explain by way of example only, the principles of the invention.

DETAILED DESCRIPTION OF THE PREFERRED EMBODIMENTS

As will be appreciated the present invention is capable of other and different embodiments than those discussed above and described in detail below, and its several details are capable of modifications in various aspects, all without departing from the spirit of the invention. Accordingly, the drawings and description of the embodiments set forth below are to be regarded as illustrative in nature and not restrictive.

Figure 1:
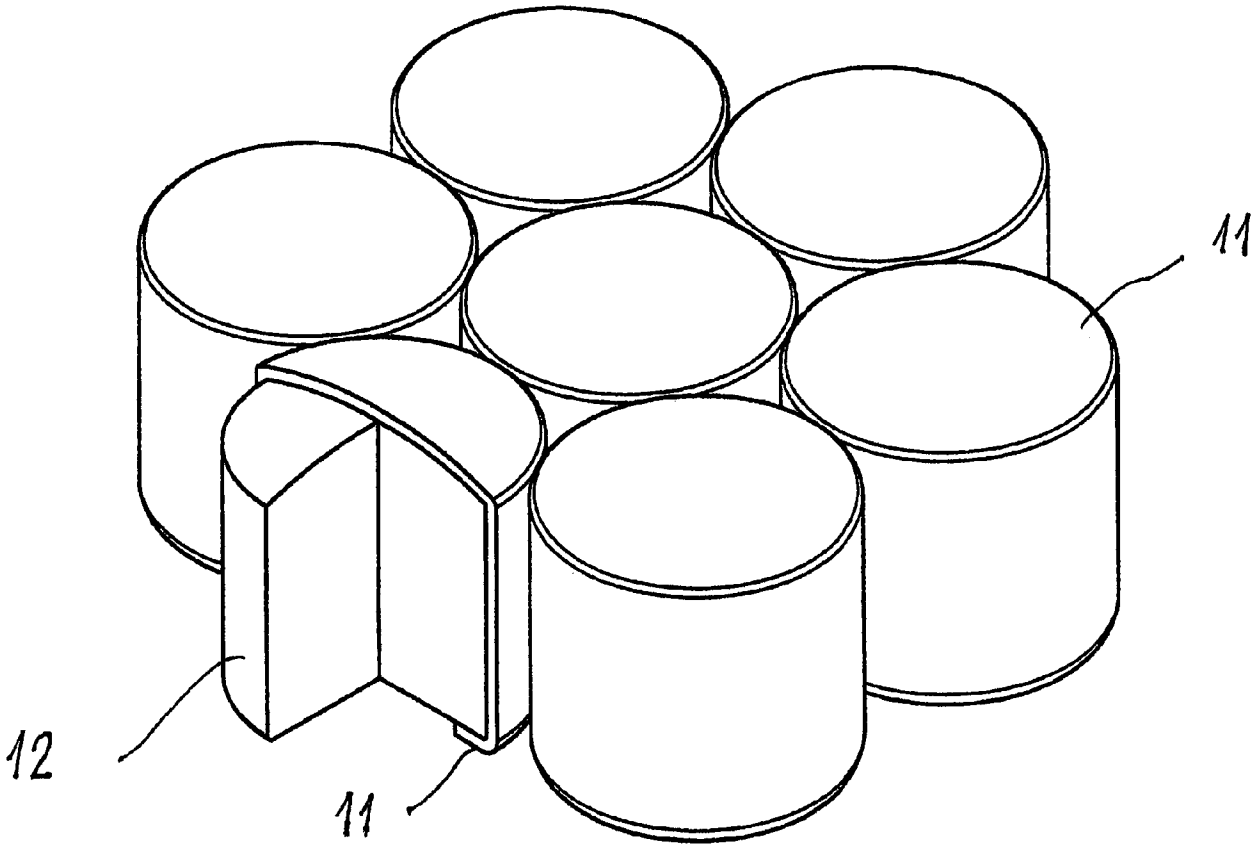
FIG. 1 is a schematic depiction in isometric projection of ceramics in a honeycomb-like arrangement of round pellets.

FIG. 1 shows individually confined cylindrical ceramic pellets 12. The pellets 12 are held by an outer casing (not shown) embedded in rubber (not shown) in a honeycomb-like arrangement. The outer enclosure shell 11 holds the pellet 12 inside the enclosure 11 under three dimensional pressure.

The strike face of each pellet is covered by the domed segment of the enclosure shell which exerts pressure onto the strike face.

The gaps between adjacent pellets are made to be small enough for avoiding the creation of a weak point and stopping an anticipated projectile between the pellets.

Only six pellets are shown in the figure while an armor plate can comprise any number of pellets in a honeycomb-like arrangement.

Figure 2:
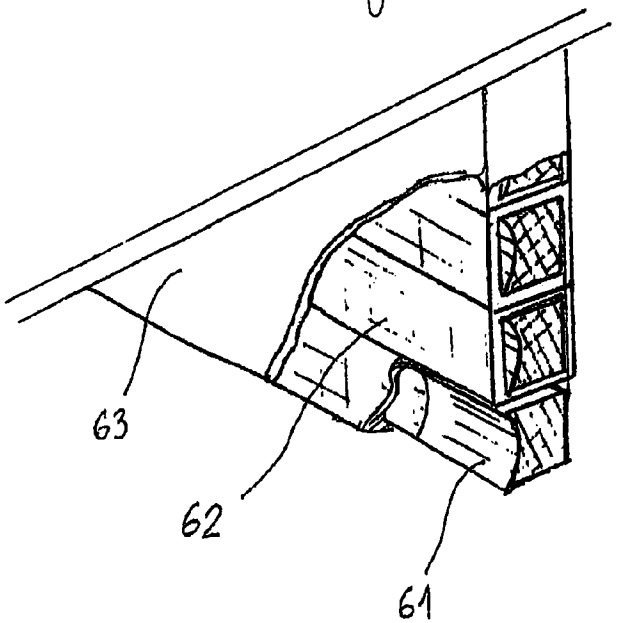
FIG. 2 is a schematic depiction in isometric projection with broken view of pre-stressed members of elongated square cross-section enclosures with concave ceramic elements.

FIG. 2 shows a broken view of a pre-stressed armor layer that comprises a plurality of pre-stressed parallel elongated rectangular members, each member, comprises a steel elongated enclosure 62 having a rectangular cavity. A plurality of Prism-like shaped ceramic elements 61 are disposed within each cavity, the elements comprises a concave strike face. The enclosure exerts pressure onto the ceramic elements. The members are glued to an Aluminum sheet metal facing layer 63.

Figure 3:
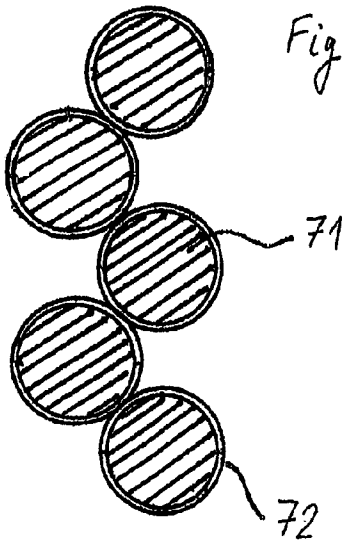
FIG. 3 is a schematic depiction in sectional view of an overlapping arrangement of round pre-stressed members comprising elongated cylindrical ceramic elements.

FIG. 3 shows a sectional view of a pre-stressed armor layer that comprises parallel elongated cylindrical members arranged in two overlapping parallel layers, the members are perpendicular to the local armor surface. The ceramic elements 71 are disposed within the tubular enclosures 72 under pressure.

Figure 4:
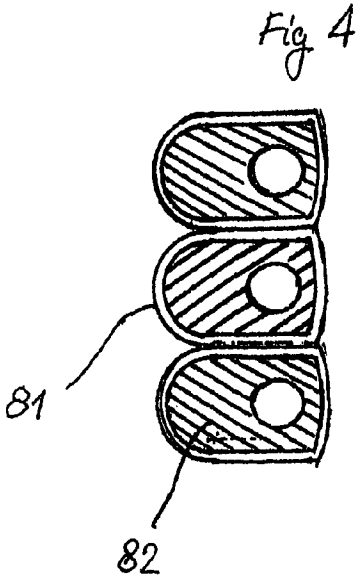
FIG. 4 is a schematic depiction in sectional view of convex pre-stressed members with hollow ceramic elements.

FIG. 4 shows a sectional view of a pre-stressed armor layer that comprises parallel elongated members arranged in a single layer, the members are attached. The hollow ceramic prism-like elements 82 are disposed within the enclosures 81 under pressure. The surfaces of the enclosures where in contact with the adjacent members are flat, the "external" surfaces towards the armor front and back are curved.

Figure 5:
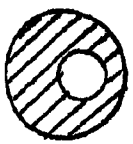
FIG. 5 is a schematic depiction in sectional view of a hollow cylindrical ceramic element.

FIG. 5 shows a section of a hollow cylindrical ceramic element.

Figure 6:
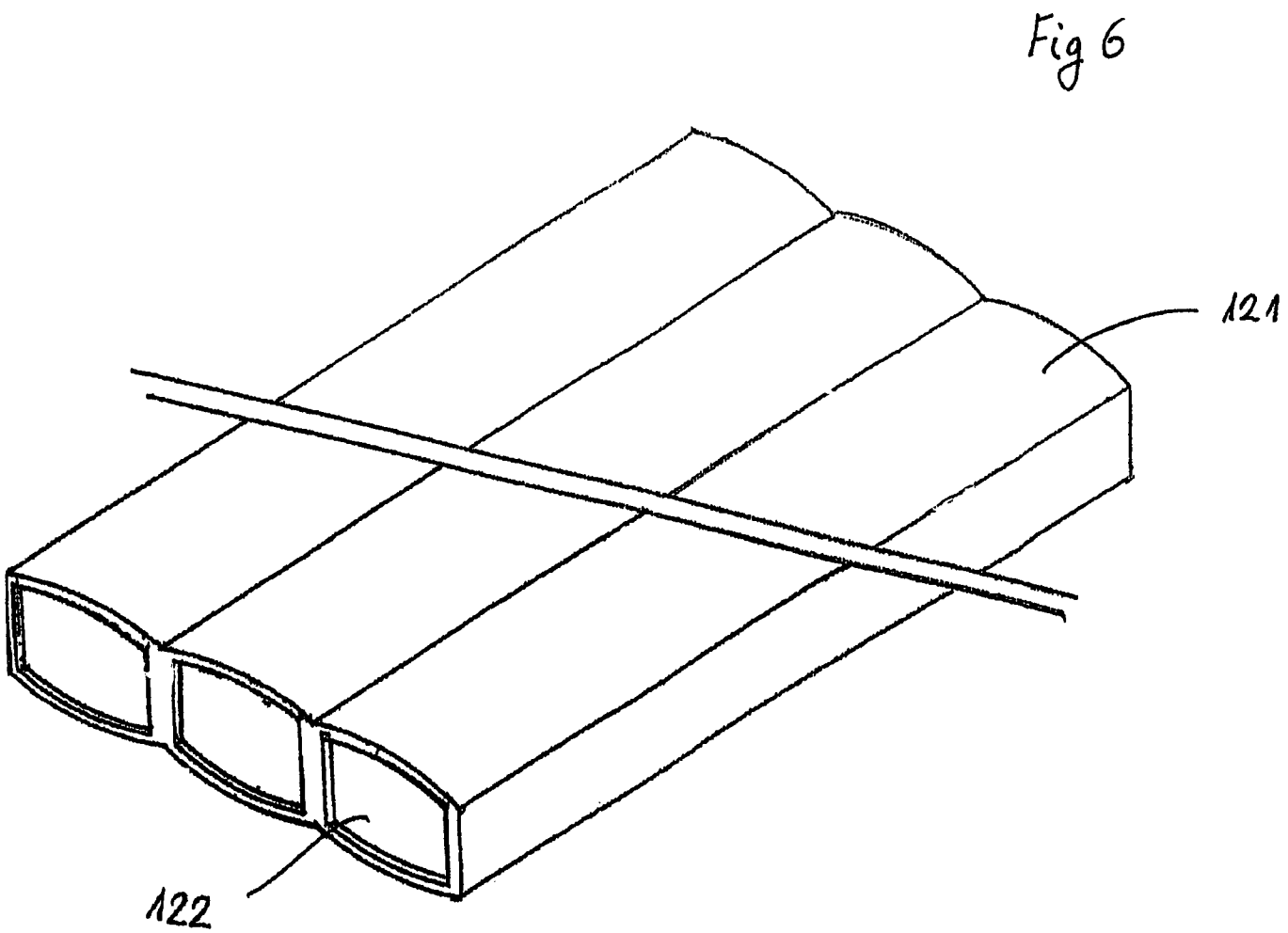
FIG. 6 is a schematic depiction in isometric projection of a pre-stressed board armor member that comprises multiple parallel prism-like shaped cavities comprising pressurized ceramic elements.

FIG. 6 shows an isometric projection of a composite armor layer that comprises a hollow board 121 made of high tensile strength and low creep material, board comprises multiple elongated cavities of uniform cross section. The cavities are parallel to each other and perpendicular to the board external surface. Ceramic elements 122 are disposed within each cavity and subjected to pressure by the board.

The board 121 comprises single curved or cylindrical external surfaces and flat inter-cavity surfaces.

Figure 7:
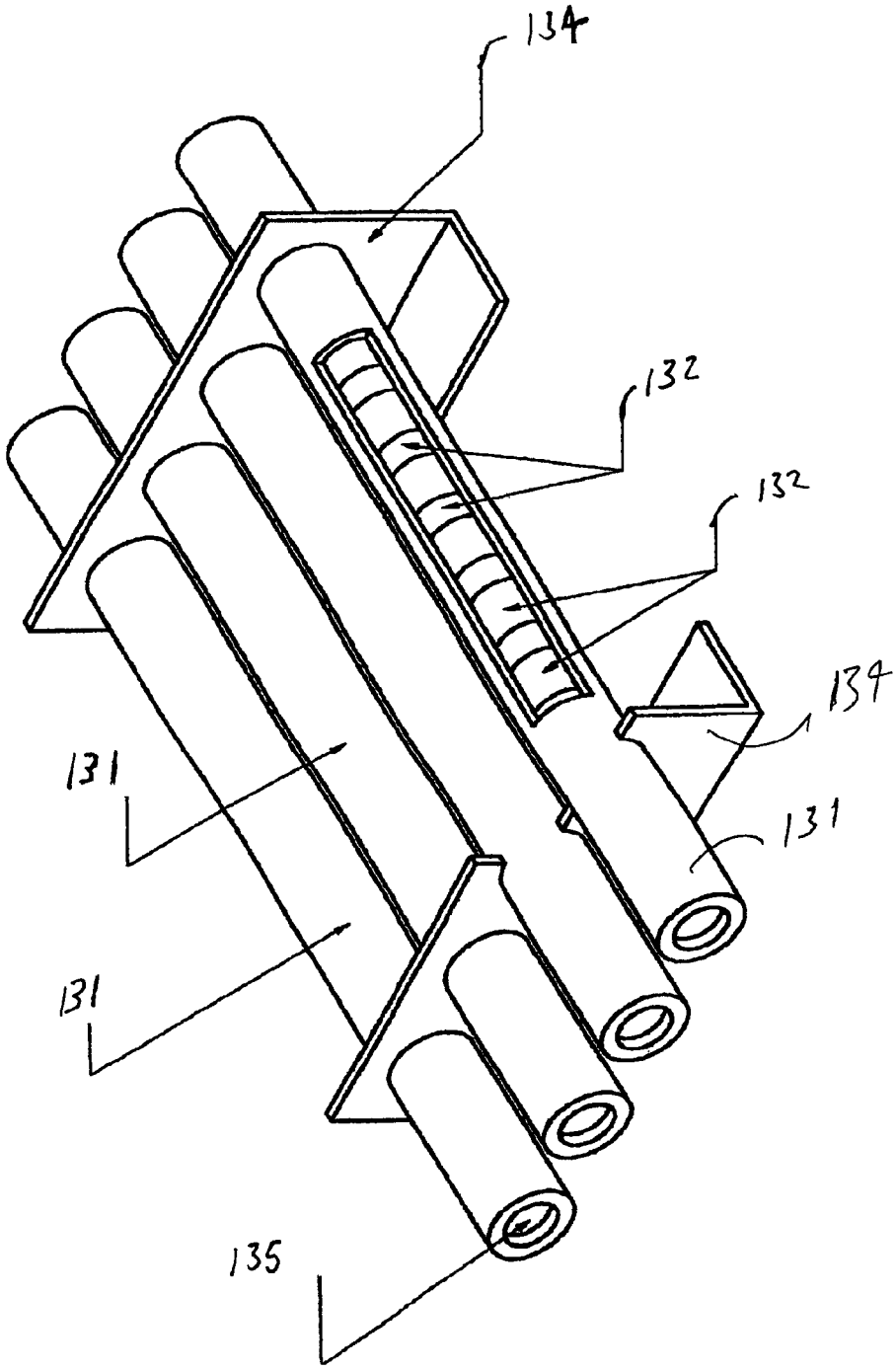
FIG. 7 is a schematic depiction in isometric projection of a pre-stressed auxiliary armor layer that comprises a spacious grating of hollow rods disposed in front of a main armor layer at a determined distance.

FIG. 7 shows an isometric projection of a pre-stressed auxiliary layer disposed in front of a main armor layer at a determined distance. Flanges 134 hold multiple steel tubes enclosures 131 at a determined distance ahead of a main armor layer.

The tubes are arranged in a spacious parallel grating pattern, cylindrical ceramic elements 132 separated by aluminum spacers 133 are disposed within the tubes and subjected to pressure. A plug 135 is used for the production of the member.

Figure 8:
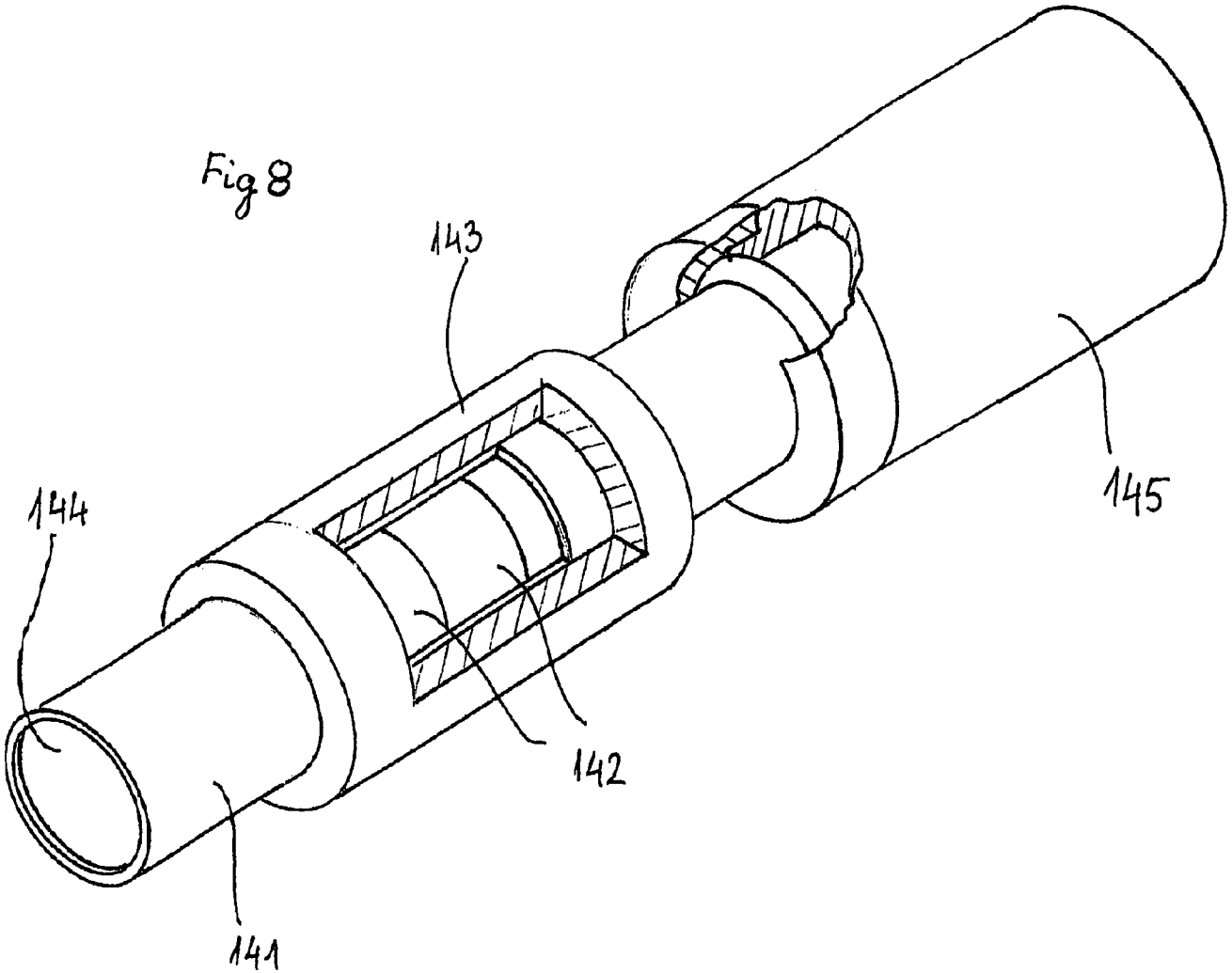
FIG. 8 is a schematic depiction in isometric projection of a jig assembly for producing pre-stressed armor members by pressure expansion of tube shaped enclosure.

FIG. 8 shows a broken view of an elongated cylindrical pre-stressed armor member in the production phase.

A plug 144 seals the tube enclosure 141 on one side.

The other side of the tube 141 is opened to a pressure chamber 145. Ceramic elements 142 are at first disposed in the pressure chamber 145. The tube enclosure is disposed into a jig 143 that limits the amount of expansion of the enclosure 141 and also serves safety purposes.

The pressure chamber is pressurized with a fluid the enclosure 141 expands to a degree that allows the ceramic elements 142 to enter with ease into the enclosure cavity.

The elements are then disposed in the enclosure with the aid of an actuator (not shown), the chamber 145 is depressurized the fluid exits from the enclosure which contracts onto the ceramic elements, the enclosure 141 remains under tension and pressurized by the ceramic elements 142. The pressurized member can then be removed from the jig and pressure chamber.

What is claimed:

1. A ballistic armor that comprises a hollow board having an external strike face, said board comprises multiple elongated cavities of uniform cross section having flat intercavity surfaces, wherein the cavities have long axes that are substantially parallel to the board external surface and have at least one convex surface facing said external strike face of the board, and wherein at least one ceramic element is disposed within each cavity and, the board comprises a material of high tensile strength with respect to the ceramic element, and said material is of a low creep type, and wherein the ceramic elements are subjected to compression and said board is in tension.

2. The ballistic armor according to claim 1 wherein an aspect ratio of said ceramic element is in the range of 0.3 to 2.

3. The ballistic armor according to claim 1 wherein the multiple elongated cavities of the board comprise tensioned pre-stressed enclosure members comprising one or more of Aluminum, Titanium, carbon fibers and steel, and whereby a plurality of the enclosure members are arranged in a pattern in said board.

4. The ballistic armor according to claim 1 wherein said elongated cavities exert pressure on the said ceramic elements.

5. The ballistic armor of claim 3 wherein said enclosure members are hollow rods arranged in a grating pattern.

* * * * *